United States Patent [19]

Crudgington

[11] 4,017,021

[45] Apr. 12, 1977

[54] COIN ROLL

[76] Inventor: Cleveland B. Crudgington, 2798 S. Highland Drive, Las Vegas, Nev. 89102

[22] Filed: Mar. 8, 1976

[21] Appl. No.: 664,545

[52] U.S. Cl. ..... 229/87.2
[51] Int. Cl.[2] ..... B65D 65/04
[58] Field of Search ..... 133/1 R, 1 A; 229/87.2, 229/87 C, 87 F, 87 G, 89, 51 TS

[56] References Cited

UNITED STATES PATENTS

| | | | |
|---|---|---|---|
| 1,420,285 | 6/1922 | Reinhold | 229/87.2 |
| 3,372,856 | 3/1968 | Erhart et al. | 229/51 TS |

*Primary Examiner*—Allen N. Knowles
*Attorney, Agent, or Firm*—Kurt A. Tauchen

[57] ABSTRACT

A coin roll so constructed that its jacket may easily be broken up and ready access be had to all the coins contained therein. The areas of the jacket adjacent the coin retaining crimps at the upper and lower ends of the roll are each provided with a row of staggered, parallel, outwardly tilted slits that make it possible to unwrap and remove the central area of the jacket in the manner of a circumferential tear strip so that most of the coins in the stack are released. At the same time the crimps at the ends of the jacket that formerly retained a small number of coins stubbornly, and made it difficult to dislodge them therefrom, have now lost their ability to retain these coins due to the fact that the outer end portions of the slits extend into the crimped areas of the jacket. As an additional aid in unwrapping the center area of the jacket, lines of perforations in the form of aligned, longitudinally extending slits may be provided in the wrapper adjacent the inner ends of the tilted slits.

6 Claims, 4 Drawing Figures

COIN ROLL

BACKGROUND OF THE INVENTION

The present invention relates to coin rolls i.e., stacks of superposed coins that are wrapped in paper or sheets of plastic material so that predetermined numbers of the coins may easily be carried to different places of need. Such coin rolls are used in banks, supermarkets and casinos and in fact in any place of business where large amounts of small change are needed. The difficulty with such coin rolls is that it is time-consuming and troublesome to recover the coins therefrom when needed. If the rolls are broken over table corners, the released coins will spill haphazardly over the table surface and may even fall to the floor, and no matter how the coin rolls were broken in the past, the crimped areas at the ends of the rolls stubbornly retained a certain number of coins which were either lost, or at least it was difficult and time-consuming to recover them by separate manipulations aimed at tearing these crimped areas apart.

OBJECTS OF THE INVENTION

It is an object of the invention to provide a coin roll from which all the coins may readily be covered without loss of time.

It is a particular object of the invention to provide a coin roll from which all the coins may readily be removed including those in the crimped end portions of the roll.

Moreover it is an object of the invention to provide a coin roll from which all the coins including those lodged in the crimped end portions of the roll may easily be released by a single manipulation.

An additional object of the invention is to provide a coin roll, of the type referred to, whose jacket is of simple and inexpensive construction.

SUMMARY OF THE INVENTION

In accordance with the invention the jacket of the coin roll is provided with circumferential rows of outwardly tilted, staggered, parallel slits in areas immediately adjacent the crimps at the opposite ends of the rolls, and adjacent the inner ends of said slits there are circumferential perforation lines in the form of aligned relatively spaced, longitudinally extending slits. The staggered oblique slits and the perforation lines make it easily possible to remove the whole center area i.e. the major portion of the jacket much in the manner of a circumferential tear strip of a width equal to the distance between the crimped areas of the rolls, and due to the fact that the outer ends of the tilted slits reach into the crimped end areas of the rolls, the crimps lose the ability to retain coins and readily release any coins lodged therein so that by a single, simple manipulation, namely the tearing away of the center area of the jacket, all coins in the roll are immediately and readily available.

DESCRIPTION OF A PREFERRED EMBODIMENT OF THE INVENTION

Figure 1:
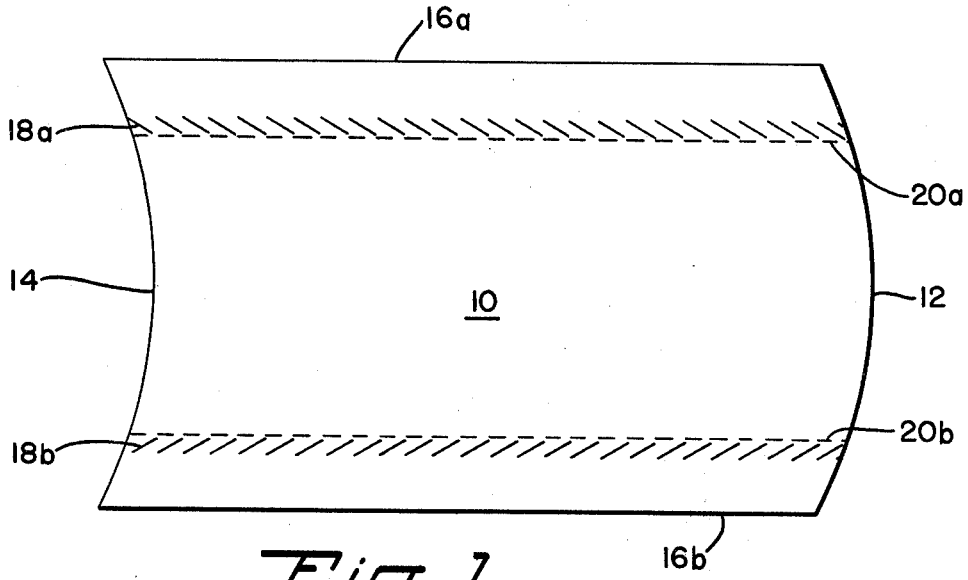
FIG. 1 is a plan view of the blank for the jacket of a coin roll constructed in accordance with my invention.

FIG. 1 shows the blank 10 of the jacket for the coin roll of the invention. It is a tape of paper or plastic sheet material having a convex leading end edge 12 i.e., the edge first applied to the coin roll to be wrapped, and a concave trailing end edge 14, i.e., the outmost end edge on the completed coin roll. Provided in tape 10 a limited distance removed from its side edges **16*a* and 16*b* are rows of oblique, parallel slits 18*a* and 18*b*, the arrangement being such that the outer ends of said slits, i.e., the ends adjacent the longitudinal side edges 16*a* and 16*b*, respectively, are higher, i.e., closer to the trailing end edge 14 of the tape than their inner ends. The angle of inclination of said slits relative the side edges of the tape may range from about 20° to about 35° and the preferred length of the slit is in the neighborhood of about one-fourth of an inch, the exact size of these dimensions depending on the size of the coins to be wrapped in the jacket. Adjacent the inner ends of the slits 18*a* and 18*b* the blank 10 is provided with longitudinally extending lines of perforations 20*a* and 20*b***. In the particular embodiment of the invention the lines of perforations are formed by longitudinally aligned, relatively spaced slits.

Figure 2:
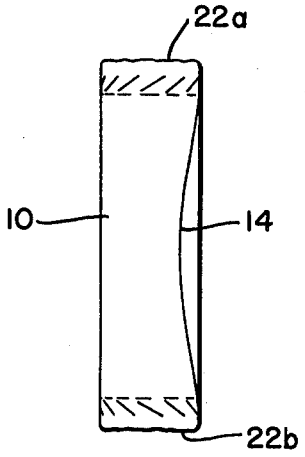
FIG. 2 is a side elevation of the coin roll in accordance with my invention.

In conventional coin wrapping machines stacks of coins are wrapped in one or several convolutious of the tape which may be supplied to the machine from a supply roll from which the proper lengths are cut intermittenly during operation of the coin wrapping mechanism. As the proper length of tape is being wrapped around the stack mechanism enters into operation that crimps the longitudinal edge areas of the tape over the ends of the coin stack, as shown at **22*a* and 22*b* in FIGS. 2 and 3**, to retain the coins in the cylindrical jacket formed by the tape and to hold the jacket in place without need for glue. The coin roll may now be handled like any conventional coin roll.

Figure 3:
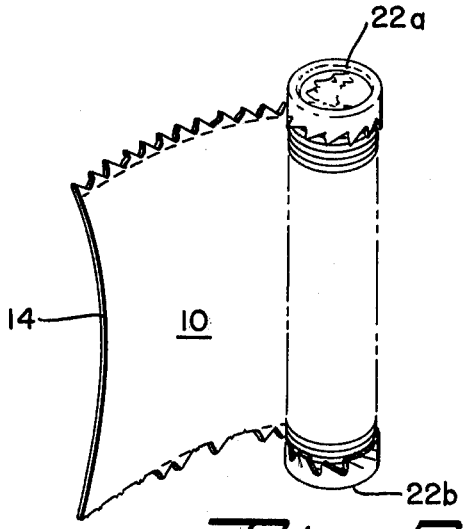
FIG. 3 is a perspective of the coin roll with the center area of the jacket partially unwrapped.
Figure 4:
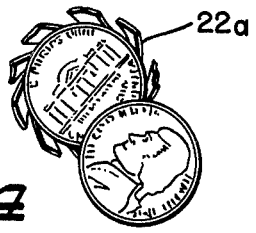
FIG. 4 is an inside end view of one of the crimped end portions of the jacket after the center portion of the jacket has been removed.

When the time comes to recover the coins in the roll, the user inserts his finger under the concave outermost end edge 14 of the jacket and lifts the center portion of the tape from the coin roll tearing it in the manner of a tear strip along the rows of slits **18*a* and 18*b* as shown in FIG. 3. This will release most of the coins in the stack for instant use, and due to the fact that the outer ends of the slits 20*a* and 20*b* reach into the crimped areas 22*a* and 22*b* of the jacket, the end portions of the jacket are now incapable of retaining any coins. Thus, coins lodged therein will drop readily from these end portions or may easily shaken out of the end positions (FIG. 4) without need to tear the crimped end areas of the jacket apart in separate manipulations. Thus, the rows of slanted slits 18*a* and 18*b* at the ends of the jacket adjacent the crimps 22*a* and 22*b***, respectively accomplish two objects in a single stroke, they open the coin jacket laying open the greater part of the coin stack therein and they also incapacitate the retentive ability of the crimped end areas of the coin roll.

The lines of aligned slots **20*a* and 20*b*** serve as a safety measure during unwrapping of the center portion of the jacket in the event that an obstruction should develop in tearing the center portion of the jacket from oblique slit to oblique slit.

What I claim is:

1. A coin roll comprising a cylindrical jacket in the form of a tape surrounding a stack of superposed coins, crimps formed on the opposite ends of said jacket to retain the stack of coins in said jacket, and a circumferential series of oblique parallel slits in the areas of said jacket adjacent to said crimps, said slits extending into said crimps.

2. A coin roll according to claim 1 wherein said tape has a concave trailing edge.

3. A coin roll according to claim 1 wherein said lines of perforations are lines of relatively spaced aligned slits parallel to the side edges of said tape.

4. A coin roll according to claim 1 wherein said jacket is formed by convolutions of a tape having an outwardly located trailing end edge and said slits are outwardly tilted with the ends of said slits first encountered when unwrapping said jacket located adjacent said crimps.

5. A coin roll according to claim 1 wherein said tape contains parallel circumferential lines of perforations adjacent the inner ends of said slits.

6. A coin roll according to claim 5 wherein said lines of perforations are formed by rows of longitudinally aligned spaced slits.

* * * * *